US007763577B1

(12) United States Patent
Chang et al.

(10) Patent No.: US 7,763,577 B1
(45) Date of Patent: Jul. 27, 2010

(54) ACIDIC POST-CMP CLEANING COMPOSITION

(75) Inventors: Song-Yuan Chang, Chia-Yi (TW); Ming-Hui Lu, Taipei (TW); Wen-Jsai Jsai, Hsinchu (TW); Po-Yuan Shen, Taoyuan (TW)

(73) Assignee: Uwiz Technology Co., Ltd., Taoyuan County (TW)

( * ) Notice: Subject to any disclaimer, the term of this patent is extended or adjusted under 35 U.S.C. 154(b) by 4 days.

(21) Appl. No.: 12/394,390

(22) Filed: Feb. 27, 2009

(51) Int. Cl.
*C11D 1/12* (2006.01)
*C11D 3/26* (2006.01)
*C11D 3/20* (2006.01)
*C11D 3/33* (2006.01)

(52) U.S. Cl. ..... 510/175; 510/245; 510/254; 510/426; 510/434; 510/477; 510/488; 510/499; 510/504; 510/495; 438/692

(58) Field of Classification Search ..... 510/175, 510/245, 254, 421, 426, 434, 477, 488, 499; 438/692
See application file for complete search history.

(56) References Cited

U.S. PATENT DOCUMENTS 4,452,643 A * 6/1984 Martin et al. ..... 134/3
5,641,739 A * 6/1997 Kott et al. ..... 510/372
5,965,514 A * 10/1999 Wierenga et al. ..... 510/433
5,977,054 A * 11/1999 Wierenga ..... 510/503
6,447,563 B1 * 9/2002 Mahulikar ..... 51/309
6,627,546 B2 * 9/2003 Kneer ..... 438/687
7,087,564 B2 * 8/2006 Misra et al. ..... 510/175
7,169,741 B2 * 1/2007 Barry et al. ..... 510/337
7,208,049 B2 * 4/2007 Zhang et al. ..... 134/3
2003/0104770 A1 * 6/2003 Pasqualoni et al. ..... 451/60
2004/0216388 A1 * 11/2004 Mathur et al. ..... 51/298
2006/0073997 A1 * 4/2006 Leonte et al. ..... 510/175
2006/0213868 A1 * 9/2006 Siddiqui et al. ..... 216/88

* cited by examiner

*Primary Examiner*—Gregory R Del Cotto
(74) *Attorney, Agent, or Firm*—Jianq Chyun IP Office

(57) ABSTRACT

An acidic post-CMP cleaning composition includes at least one polyamino-polycarboxylic acid, or salt thereof; at least one hydroxycarboxylic acid, or salt thereof; and the remainder being substantially water. The acidic cleaning composition also includes a surfactant. The acidic post-CMP cleaning composition has a pH of 1 to 5, and is useful for removing the contaminants from the wafer surface after a CMP process without making roughness worse.

10 Claims, No Drawings

ACIDIC POST-CMP CLEANING COMPOSITION

BACKGROUND OF THE INVENTION

1. Field of the Invention

The present invention generally relates to a cleaning composition, and more particularly to an acidic cleaning composition that is useful for removing the contaminants (such as abrasives, metal complexes, and organic compounds) from a wafer surface after a chemical mechanical polishing (CMP) process.

2. The Prior Arts

After copper deposition in the sub-micron copper (Cu) damascene procedure, the Cu-chemical mechanical polishing (Cu-CMP) process is performed in order to remove the excess Cu residing above the low-k dielectric layer and leaving the Cu inside the contact/via openings in the low-k dielectric layer.

In a chemical mechanical polishing process or a chemical mechanical planarization process, the wafer surface is mechanically polished for planarization by using a chemically reactive slurry. Slurries used in Cu-CMP process typically include 5 to 10 wt % of nano-abrasives (such as $SiO_2$, $Al_2O_3$, $CeO_2$, and $ZrO_2$) with diameters of 30-100 nm; a chemical auxiliary agent (such as a pH buffer agent); an oxidizing agent (such as hydrogen peroxide, iron nitrate, and potassium iodate); a complexing agent; a corrosion inhibitor (such as benzotriazole (BTA)); and other compounds that act as protective film or act as surfactant. In the CMP process, the slurry is introduced to the wafer on a planarization table in conjunction with polishing pad, and the table and the wafer carrier are simultaneously rotated in order to polish the surface of the wafer. Consequently, a large amount of abrasives, metal, Cu-BTA complex compounds and other metallic and non-metallic contaminants will remain on the wafer surface after the CMP process. If the post-CMP cleaning solution used for removing the extrinsic contaminants left on the wafer surface after a CMP process is not effectively, the subsequent processes (such as thin layer deposition, photolithography, and etc.) will be detrimentally affected, and that will account for the enhanced degradation of device reliability.

In the conventional post-CMP cleaning process, the post-CMP cleaning solution which usually contains ammonium hydroxide was used together with the supersonic wave, spray, and brush devices in order to remove the contaminants from the wafer surface. The conventional post-CMP cleaning solution also usually included a surfactant which is also called a wetting agent that is able to lower the surface tension of the post-CMP cleaning solution, allowing easier spreading. However, the post-CMP cleaning solutions containing amines will smell very fishy, and the amines released from the cleaning solution can poison the photoresist stored in the wafer Fab and lead to reliability issues.

The cleaning compositions used after the CMP process have been described in prior art. The following are U.S. patents which describe such cleaning compositions: U.S. Pat. No. 7,208,049 disclosed a cleaning composition containing one or more surfactants that are used to reduce the number of defects in the manufacture of semiconductor devices. U.S. Pat. No. 6,627,546 disclosed a fluoride-free aqueous cleaning composition containing a dicarboxylic acid and/or salt thereof. U.S. Pat. No. 7,087,564 disclosed a cleaning composition containing ammonium citrate, and corrosion-inhibiting compounds (such as ascorbic acid, and cysteine).

There is still a need for a post-CMP cleaning composition for copper-containing wafer surface. Such a post-CMP cleaning composition should be able to effectively and efficiently remove the contaminants from the wafer surface while the roughness of the wafer surface only increases a little bit after such a post-CMP cleaning composition is used on a contaminated surface, so that the subsequent processes (such as thin layer deposition, photolithography, and etc.) can be favorably carried out.

SUMMARY OF THE INVENTION

Accordingly, the objective of the present invention is to provide an acidic post-CMP cleaning composition that is used to effectively and efficiently remove the contaminants from the wafer surface, and especially used to effectively and efficiently remove BTA and copper oxide (remaining on the Cu layer), and copper residues (remaining on the dielectric layer, such as FSG layer) from the wafer surface after a Cu-CMP process. In the meanwhile, the extent of copper etching is very low after using the acidic cleaning composition of the present invention for removing the contaminants from the wafer surface after a CMP process, and consequently the problem of wafer surface roughness is alleviated so that the subsequent processes (such as thin layer deposition, photolithography, and etc.) can be carried out in the best possible manner.

To achieve the foregoing objective, the present invention provides an acidic post-CMP cleaning composition comprises at least one polyamino-polycarboxylic acid, or salt thereof; at least one hydroxycarboxylic acid, or salt thereof; and the remainder being substantially water. The acidic post-CMP cleaning composition has a pH of 1 to 5, and is useful for removing the contaminants, especially the metallic and non-metallic particulates from the wafer surface after a CMP process.

The acidic post-CMP cleaning composition of the present invention further comprises at least one surfactant. The surfactant serves to enhance the wettability of the acidic post-CMP cleaning composition to the wafer surface, and controls the etching rate of copper.

The acidic post-CMP cleaning composition of the present invention further comprises tetramethylammonium hydroxide, ammonium hydroxide, tetrabutylammonium hydroxide, tetraethylammonium hydroxide, benzyltrimethylammonium hydroxide, dimethyldiethylammonium hydroxide, tetrapropylammonium hydroxide, phosphazenes (such as BEMP), or amines (such as trimethyamine).

Advantageously, the acidic post-CMP cleaning composition of the present invention can effectively and efficiently remove the contaminants, such as abrasives, metal complexes, and organic compounds, from the wafer surface after a chemical mechanical polishing (CMP) process while alleviating the problem of wafer surface roughness.

The foregoing and other objects, features, aspects and advantages of the present invention will become better understood from a careful reading of a detailed description provided herein below.

DETAILED DESCRIPTION OF THE PREFERRED EMBODIMENTS

A better understanding of embodiments of the present invention can be obtained from the following detailed description.

Before describing the details of the various preferred embodiments of this invention, some of the terms that are used herein will be defined.

The term "wafer" as used herein refers to the wafer used in microelectronic devices and integrated circuit devices. The term "contaminant" as used herein refers to the reaction by-products, metal residues, and chemicals existing in the CMP slurry. The term "dielectric layer" as used herein refers to the dielectric layer having a dielectric constant less than 3.5, such as organic polymer containing silicon, organosilicate glass (OSG), tetraethylorthosilicate (TEOS), fluorinated silicate glass (FSG), silicon dioxide, and/or carbon-doped oxide (CDO) glass.

The acidic post-CMP cleaning composition of the present invention comprises at least one polyamino-polycarboxylic acid, or salt thereof; at least one hydroxycarboxylic acid, or salt thereof; at least one surfactant; and the remainder being substantially water.

The acidic post-CMP cleaning composition of the present invention can be used to effectively and efficiently remove the contaminants from the wafer surface after a Cu-CMP process at room temperature with just flushing.

The acidic post-CMP cleaning composition of the present invention can prevent the redeposition of undesirable metal or metal complex contaminants on the wafer surface.

The present invention is illustrated in more detail with reference to the following Examples, which are for illustrative purposes and should not be construed as limiting the scope of the present invention.

Preparation of Acidic Post-CMP Cleaning Compositions

Five acidic post-CMP cleaning compositions are prepared, and the weight ratios of the compositions and their physical properties are reported in Table 1:

TABLE 1

| Sample | Citric acid wt % | DTPA wt % | Lauryl-benzene-Sulfonic acid, wt % | Lauryl-sulfonate wt % | Secondary alcohol ethoxylate, wt % | TMAH wt % | pH | Surface tension | Contact Angle |
|---|---|---|---|---|---|---|---|---|---|
| 1 | 8 | 0.2 | 0.5 | 0 | 0 | 0 | 1.6 | 44.7 | 25 |
| 2 | 8 | 0.2 | 0.2 | 0.2 | 0.2 | 0 | 1.6 | 27.4 | 25 |
| 3 | 8 | 0.2 | 0.2 | 0.4 | 0 | 0 | 1.6 | 35.8 | 25 |
| 4 | 8 | 0.2 | 0.2 | 0 | 0.4 | 0 | 1.6 | 26.9 | 25 |
| 5 | 8 | 0.2 | 0.2 | 0 | 0.4 | 3 | 3.7 | 26.8 | 25 |

*DTPA: Diethylene triamine pentaacetic acid
TMAH: Tetramethyl ammonium hydroxide The pH of the acidic post-CMP cleaning composition of the present invention is adjusted to a pH of from 1 to 5, and preferably from 2 to 4 using ammonia water or tetramethylammonium hydroxide, and the pH of the acidic post-CMP cleaning composition is measured with the glass-reference electrode-pH meter assemblies.

Examples of polyamino-polycarboxylic acids useful in the present invention include monoamino-polycarboxylic acid, diamino-polycarboxylic acid, triamino-polycarboxylic acid, and the like. The preferable polyamino-polycarboxylic acid is triamino-polycarboxylic acid, and more preferable is triamine pentaacetic acid, such as ethylene triamine pentaacetic acid, diethylene triamine pentaacetic acid, and triethylene triamine pentaacetic acid. Preferred salts include the alkali metal, alkaline earth metal and ammonium salts. The polyamino-polycarboxylic acid and/or salt is present in an amount from 0.001 to 10% by weight, and preferably from 0.0025 to 5% by weight, based on the total weight of the acidic post-CMP cleaning composition.

Examples of hydroxycarboxylic acids useful in the present invention include malic acid, tartaric acid, lactic acid, and citric acid. The preferred hydroxycarboxylic acid is citric acid. Preferred salts include alkali metal, alkaline earth metal and ammonium salts. The hydroxycarboxylic acid is present in an amount from 0.05 to 20% by weight, and preferably from 0.2 to 5% by weight, based on the total weight of the acidic post-CMP cleaning composition.

The surfactant is anionic or nonionic. Preferably, the surfactant useful in the present invention is selected from the group consisting of alkylsulfonic acid, alkylbenzenesulfonic acid, alkylsulfuric acid, sulfosuccinate, 2-aminoethanesulfonic acid, nonoxynol-4 sulfate, and secondary alcohol ethoxylate. The surfactant is present in an amount from 0.001 to 10% by weight, and preferably from 0.0025 to 5% by weight, based on the total weight of the acidic post-CMP cleaning composition.

Contact angle is a quantitative measure of the wetting of a solid by a liquid. The contact angle of each sample listed in Table 1 is determined by the following steps: (a) one drop of each sample is dropped onto the Cu wafer; (b) the image of the sample drop on the Cu wafer is captured with a high speed CCD; and (c) the captured images are analyzed with computer software.

The surface tension of each sample listed in Table 1 is determined by the following steps: (a) each sample was diluted with 39 folds (by weight) of DI water first; (b) one drop of each diluted sample is dropped by a syringe, and the drop falling process was recorded by a CCD camera; (c) the image of the drop held at the syringe tip just before falling down is captured; and (d) the captured image is analyzed with computer software.

The following tests are conducted to evaluate the cleaning performance of samples 1 to 5 listed in Table 1:1) the rate of copper loss (or dynamic etching rate) of Cu blanket wafer; 2) Static etching rate of Cu blanket wafer; 3) copper residues on FSG blanket wafer; and 4) 1H-benzotriazole residues and copper oxide residues on Cu blanket wafer.

Rate of Copper Loss

Example 1

One 8" Cu blanket wafer with thickness of 2000 Å is delivered through the inside of an Ontrak post CMP brush box (Lam Research, CA USA), and the 8" Cu blanket wafer is flushed (or washed) with sample 1 of Table 1 at a rate of 300 ml/min while passing through two brush boxes (brush box 1 and brush box 2) disposed inside of the post CMP brush box, and the wafer passes directly from one brush box through the other. The wafer is washed while passing through the two brush boxes with a total time of 50 seconds (30 seconds wash inside brush box 1, and 20 seconds wash inside brush box 2) and then is dried. The change of copper film thicknesses at five sites on the wafer before and after wash is measured using a X-ray Fluorescence Spectrometer (XRF), and the five values of thickness difference (at five sites) are averaged. The difference between the thickness of copper film before wash and the thickness of copper film after wash is associated with the rate of copper loss (or dynamic etching rate). The measured values are shown in Table 2.

Example 2

The procedure of Example 1 is repeated except that sample 2 is used instead of sample 1, and two 8" Cu blanket wafers instead one. The measured values are shown in Table 2.

Example 3

The procedure of Example 1 is repeated except that sample 3 is used instead of sample 1. The measured values are shown in Table 2.

Example 4

The procedure of Example 1 is repeated except that sample 4 is used instead of sample 1, and two 8" Cu blanket wafers instead one. The measured values are shown in Table 2.

Example 5

The procedure of Example 1 is repeated except that sample 5 is used instead of sample 1, and two 8" Cu blanket wafers instead one. The measured values are shown in Table 2.

TABLE 2

| | | | XRF 5-points average value | | |
|---|---|---|---|---|---|
| Sample | Wash time (brush box 1) | Wash time (brush box 2) | Before wash Cu film thickness (Å)) | After wash Cu film thickness (Å) | Difference in Cu film thickness Cu loss rate (Å/min) |
| 1 | 30 sec | 20 sec | 2160.48 | 2145.86 | 17.544 |
| 2 | 30 sec | 20 sec | 2162.16 | 2146.76 | 18.48 |
| | 30 sec | 20 sec | 2170.32 | 2151.2 | 22.944 |
| 3 | 30 sec | 20 sec | 2164.06 | 2147.88 | 19.416 |
| 4 | 30 sec | 20 sec | 2172.72 | 2157.02 | 18.84 |
| | 30 sec | 20 sec | 2148.4 | 2139.78 | 10.344 |
| 5 | 30 sec | 20 sec | 2168.18 | 2157 | 13.416 |
| | 30 sec | 20 sec | 2148.64 | 2137.58 | 13.272 |

From Table 2 it knows that the rate of copper loss is low for any one of the samples 1 to 5, and it means that the wafer surface roughness only increases a little bit after cleaning the wafer with the acidic post-CMP cleaning compositions of the present invention (i.e. samples 1 to 5 listed in Table 1). Table 2 also shows that the rate of copper loss when using sample 1, 4 or 5 is lower than the rate of copper loss when using sample 2 or 3, and consequently it shows that the rate of copper loss can be adjusted by using different surfactants and different pH values of the acidic post-CMP cleaning composition.

Static Etching Rate

Example 6

One 8" Cu blanket wafer with thickness of 2000 Å is dipped in a pail filled with sample 1 listed in Table 1 for 4 hrs. Then, the wafer is rinsed with deionized water and dried after dipping. The change of copper film thicknesses at five sites on the wafer before and after dipping is measured using a X-ray Fluorescence Spectrometer (XRF), and the five values of thickness difference (at five sites) are averaged. The difference between the thickness of copper film before dipping and the thickness of copper film after dipping is associated with the static etching rate of copper. The measured values are shown in Table 3.

Example 7

The procedure of Example 6 is repeated except that sample 2 is used instead of sample 1, and two 8" Cu blanket wafers instead one. The measured values are shown in Table 3.

Example 8

The procedure of Example 6 is repeated except that sample 3 is used instead of sample 1. The measured values are shown in Table 3.

Example 9

The procedure of Example 6 is repeated except that sample 4 is used instead of sample 1. The measured values are shown in Table 3.

Example 10

The procedure of Example 6 is repeated except that sample 5 is used instead of sample 1, and two 8" Cu blanket wafers instead one. The measured values are shown in Table 3.

TABLE 3

| | | XRF 5-points average value | | |
|---|---|---|---|---|
| Sample | Dipping time (in pail) | Before dipping Cu film thickness (Å) | After dipping Cu film thickness (Å) | Difference in Cu film thickness Static etching rate (Å/min) |
| 1 | 4 hrs | 1366.28 | 1013.32 | 1.47 |
| 2 | 4 hrs | 1367.04 | 977.88 | 1.62 |
| | 4 hrs | 1439.54 | 1088.18 | 1.46 |
| 3 | 4 hrs | 1465.08 | 1034.38 | 1.79 |
| 4 | 4 hrs | 1899.58 | 1504.36 | 1.65 |
| 5 | 4 hrs | 1488.08 | 1302.22 | 0.77 |
| | 4 hrs | 1451.76 | 1262.3 | 0.79 |

From Table 3 it knows that the static etching rate is low for any one of the samples 1 to 5, and it means that the wafer surface roughness only increases a little bit after dipping the wafer into the acidic post-CMP cleaning compositions of the present invention (i.e. samples 1 to 5 listed in Table 1). Table 3 also shows that the static etching rate when using sample 1 or 5 is lower than the static etching rate when using sample 2, 3 or 4, and among them, sample 5 is the lowest one. Consequently, it shows that the static etching rate of copper can be adjusted by using different surfactants and different pH values of the acidic post-CMP cleaning composition.

Copper Residues on Fluorinated Silicate Glass (FSG) Film

Example 11

A Cu-riched polishing pad surface is prepared by respectively polishing two 8" Cu blanket wafers on a Mirra Polisher (Applied Materials, USA) for 60 seconds for each one. The polishing pad conditioning is turned off during the polishing process in order to retain more Cu residues on the polishing pad. Then, one FSG blanket wafer with diameter of 200 mm is polished on the same Mirra Polisher with the as-prepared Cu-riched polishing pad for 10 seconds. The FSG blanket wafer is now contaminated with an abundance of Cu residues from the Cu-riched polishing pad. Subsequently, the FSG blanket wafer contaminated with Cu residues is delivered through the inside of an Ontrak post CMP brush box (Lam Research, CA USA), and the FSG blanket wafer is flushed (or washed) with sample 1 of Table 1 at a rate of 300 ml/min while passing through two brush boxes (brush box 1 and brush box 2) disposed inside of the Ontrak post CMP brush box, and the wafer passes directly from one brush box through the other. The FSG blanket wafer is washed while passing through the two brush boxes with a total time of 50 seconds and then is dried. The Cu residues on the three sites of FSG blanket wafer are detected by a total reflection X-ray fluorescence (TXRF) spectrometer. The three sites are located at wafer center represented by (0,0), 87 mm left from the wafer center represented by (87,0), and 87 mm right from the wafer center represented by (−87,0), respectively. The Cu Kα intensities over the three sites of the FSG blanket wafer are measured, and the results are shown in Table 4.

Example 12

The procedure of Example 11 is repeated except that sample 2 is used instead of sample 1. The measured values are shown in Table 4.

Example 13

The procedure of Example 11 is repeated except that sample 3 is used instead of sample 1. The measured values are shown in Table 4.

Example 14

The procedure of Example 11 is repeated except that sample 4 is used instead of sample 1. The measured values are shown in Table 4.

Example 15

The procedure of Example 11 is repeated except that sample 5 is used instead of sample 1. The measured values are shown in Table 4.

TABLE 4

| | Cu— Kα intensity × $10^{10}$ atoms/$cm^2$ | | |
|---|---|---|---|
| Sample | (−87, 0) | (0, 0) | (87, 0) |
| 1 | 0 | 0 | 0 |
| 2 | 0 | 0 | 0.01 |
| 3 | 0 | 0 | 0.02 |
| 4 | 0.02 | 0 | 0 |
| 5 | 0 | 0 | 0 |

From Table 4 it knows that there is no detectable Cu Kα radiation on the FSG blanket wafer after the FSG blanket wafer is washed with samples 1 to 5 listed in Table 1. Therefore, it proves that the copper residues remaining on the FSG layer after a CMP process can be effectively removed prior to subsequent processing of the wafer in order to avoid degradation in device reliability and to avoid the introduction of defects which reduce the manufacturing process yield.

BTA and Copper Oxide Residues on Cu Film

Example 16 a 8" Cu blanket wafer is polished at a Mirra polisher using a polishing pad and slurry containing 100 ppm of 1H-benzotriazole. Pad conditioning and deionized water rinse is turned off during the polishing process in order to retain more polish residues on the polishing pad. After that, the Cu blanket wafer is dipped into a 0.3 wt % BTA solution for 30 seconds. The Cu blanket wafer is now contaminated with an abundance of BTA, copper oxide, organic oxide residues, and etc. Subsequently, the Cu blanket wafer contaminated with various residues is delivered through the inside of an Ontrak post CMP brush box (Lam Research, CA USA), and the contaminated Cu blanket wafer is flushed (or washed) with sample 1 of Table 1 at a rate of 300 ml/min while passing through two brush boxes (brush box 1 and brush box 2) disposed inside of the post CMP brush box, and the wafer passes directly from one brush box through the other. The wafer is washed while passing through the two brush boxes with a total time of 50 seconds (30 seconds wash inside brush box 1, and 20 seconds wash inside brush box 2) and then is dried. Then, the residues on the Cu blanket wafer are detected by a time-of-flight secondary ion mass spectrometer (TOF-SIMS) before and after cleaning, and the results are shown in Table 5

Example 17

The procedure of Example 16 is repeated except that sample 4 is used instead of sample 1. The measured values are shown in Table 5.

Example 18

The procedure of Example 16 is repeated except that sample 5 is used instead of sample 1. The measured values for essential residues are shown in Table 5.

TABLE 5

| Residual species | Mass peak m/z | Counts before cleaning | Counts after cleaning with sample 1 | Counts after cleaning with sample 4 | Counts after cleaning with sample 5 |
|---|---|---|---|---|---|
| Copper oxides | | | | | |
| Cu | 63 | 50663 | 40218 | 46025 | 35897 |
| CuO | 79 | 38895 | 79723 | 92843 | 71736 |
| $CuOH_x$ | 80 | 58919 | 165192 | 176636 | 150121 |
| $CuO_2H_x$ | 96 | 40784 | 229070 | 258944 | 223517 |
| Organic oxides | | | | | |
| $C_3H_5O_2$ | 73 | 65593 | 35738 | 41361 | 33473 |
| $C_3H_5O_3$ | 89 | 56312 | 4059 | 2975 | 1659 |
| BTA | | | | | |
| $C_6H_4N_3$ | 118 | 930966 | 69573 | 35990 | 1647 |
| $CuC_6H_5N_3$ | 182 | 25106 | 1532 | 995 | 352 |
| $CuOC_6H_5N_3$ | 198 | 63797 | 3340 | 1895 | 249 |
| $CuC_{12}H_8N_6$ | 299 | 40958 | 252 | 155 | 64 |

From Table 5 it knows that copper oxide, organic oxide, and especially BTA residues are effectively removed after the Cu blanket wafer is washed with samples 1, 4, or 5 listed in Table 1 after a CMP process. It is worthy of note that the removing rate of BTA residues can reach 95% and more when the acidic post-CMP cleaning composition of the present invention is used.

The advantages of the acidic post-CMP cleaning composition of the present invention are that: 1) the copper oxide, organic oxide, and BTA residues on the Cu layer of the wafer, and copper residues on the dielectric layer (such as FSG layer) of the wafer are effectively removed after the wafer is washed with the acidic cleaning composition of the present invention after a CMP process; and 2) the dynamic etching rate and the static rate of Cu are very low after the wafer is washed with the acidic cleaning composition of the present invention after a CMP process, and thereby the wafer surface roughness only increases a little bit after such a washing (or cleaning) process, so that the subsequent processes (such as thin layer deposition, photolithography, and etc.) can be carried out in the best possible manner.

Although the present invention has been described with reference to the preferred embodiments, it will be understood that the invention is not limited to the details described thereof. Various modifications have been suggested in the foregoing description, and others will occur to those of ordinary skill in the art. Therefore, all such modifications are intended to be embraced within the scope of the invention as defined in the appended claims.

What is claimed is:

1. An acidic post-CMP cleaning composition consisting of:

at least one polyamino-polycarboxylic acid, or salt thereof;

at least one hydroxycarboxylic acid, or salt thereof;

at least one surfactant, wherein the surfactant is selected from the group consisting of alkylsulfonic acid, alkylbenzenesulfonic acid, alkylsulfonic acid, sulfosuccinate, 2-aminoethanesulfonic acid, nonoxynol-4 sulfate and lauryl-sulfonate;

one of tetramethylammonium hydroxide, ammonium hydroxide, tetrabutylammonium hydroxide, tetraethylammonium hydroxide, benzyltrimethylammonium hydroxide, dimethyldiethylammonium hydroxide, tetrapropylammonium hydroxide, and phosphazenes; and water, wherein the acidic cleaning composition has a pH of 1 to 5.

2. The composition according to claim 1, wherein the polyamino-polycarboxylic acid is selected from the group consisting of monoamino-polycarboxylic acid, diamino-polycarboxylic acid, and triamino-polycarboxylic acid.

3. The composition according to claim 1, wherein the polyamino-polycarboxylic acid is triamine pentaacetic acid.

4. The composition according to claim 3, wherein the triamine pentaacetic acid is selected from the group consisting of ethylene triamine pentaacetic acid, diethylene triamine pentaacetic acid, and triethylene triamine pentaacetic acid.

5. The composition according to claim 1, wherein the salt of the polyamino-polycarboxylic acid is selected from the group consisting of alkali metal, alkaline earth metal and ammonium salts.

6. The composition according to claim 1, wherein the polyamino-polycarboxylic acid is present in an amount from 0.001 to 10% by weight based on the total weight of the acidic post-CMP cleaning composition.

7. The composition according to claim 1, wherein the hydroxycarboxylic acid is selected from the group consisting of malic acid, tartaric acid, lactic acid, and citric acid.

8. The composition according to claim 1, wherein the salt of the hydroxycarboxylic acid is selected from the group consisting of alkali metal, alkaline earth metal and ammonium salts.

9. The composition according to claim 1, wherein the hydroxycarboxylic acid is present in an amount from 0.05 to 20% by weight based on the total weight of the acidic post-CMP cleaning composition.

10. The composition according to claim 1, wherein the surfactant is present in an amount from 0.001 to 10% by weight based on the total weight of the acidic post-CMP cleaning composition.

* * * * *